United States Patent [19]

Dixon

[11] 4,320,543

[45] Mar. 23, 1982

[54] MEDICAL PILLOW

[76] Inventor: Linda H. Dixon, 5 Bon Air Rd., Larkspur, Calif. 94939

[21] Appl. No.: 181,281

[22] Filed: Aug. 25, 1980

[51] Int. Cl.[3] ..... A47G 9/00

[52] U.S. Cl. ..... 5/434; 5/436

[58] Field of Search ..... 5/434, 436, 431, 435, 5/437, 432, 481, 448; 297/DIG. 1

[56] References Cited

U.S. PATENT DOCUMENTS

| | | | |
|---|---|---|---|
| 2,940,088 | 6/1960 | Boos | 5/436 |
| 3,482,571 | 12/1969 | Behrendt | 5/436 |
| 3,974,532 | 8/1976 | Ecchuya | 5/448 |
| 4,064,578 | 12/1977 | Yamada | 5/481 |

*Primary Examiner*—Alexander Grosz

*Attorney, Agent, or Firm*—Townsend and Townsend

[57] ABSTRACT

A medical pillow providing stabilized support for the head and neck of the user and incorporating a convoluted upper surface is disclosed. The pillow is typically rectangular and has a generally flat bottom and a contoured top. The contoured top has a central depression for placement of the user's head therein and a neck supporting depression area extending between the head supporting depression and one side of the pillow. The head and neck depression areas are curved to conform to the curvature of the user's head and neck. The surface of the top is convoluted to provide more uniform vertical support and improved lateral support for the head and neck.

19 Claims, 2 Drawing Figures

MEDICAL PILLOW

BACKGROUND

It has long been known to provide specially shaped pillows for various reasons. If a patient's head and neck are not properly supported during an operation, the patient's head may roll from side to side. Such uncontrolled movement might result in serious injury to the patient.

Some pillows have been developed to keep the head steady during administration of anesthesia. Such pillows are disclosed in U.S. Pat. No. 2,199,479 and 3,694,831. Other pillows have been developed for therapeutic reasons, such as to relieve muscle tension or to promote a particular curvature of the cervical spine. See, for example, U.S. Pat. Nos. 2,700,779; 3,521,310 and 3,757,364.

In viewing the prior art, it becomes clear that the presently available medical and therapeutic pillows are generally directed to a single function, such as vertical support of the head or the positioning of the neck. However, they fail to provide the four critical modes of support for the head and neck of a supine person to protect against movement of the head and the neck; that is to simultaneously provide vertical support for the head and neck as well as lateral support for the head and neck.

SUMMARY OF THE INVENTION

A medical pillow providing both vertical and lateral support for the head and neck of the user and also incorporating a convoluted upper supporting surface is disclosed. The pillow is typically rectangular and has a generally flat bottom and a smoothly curving contoured top. The contoured top has a central depression area for placement of the user's head and a neck supporting depression area extending between the head supporting depression and one side of the pillow. The neck depression is not as deep as the head depression to insure the vertical support of both the head and the neck. The relative depths of the depressions can be chosen to allow the cervical spine to assume the desired contour. The head and neck depression are shaped to generally conform to the shape of the user's head and neck. The surface of the top is convoluted to provide more uniform vertical support and improved lateral support for the head and the neck. The medical pillow thus effectively immobilizes the head and neck in a neutral position, thus protecting the user against injury, e.g., patients requiring mechanical ventilation or comatose and the like.

The medical pillow of the present invention provides the recumbent user with four-way support; it provides for both vertical support of the head and the neck and also lateral support of both the head and the neck. The proper vertical support of the head and neck encourages a normal curvature of the spine, such as when sleeping. By proper choice of the depths of the head and neck depressions, the head can be supported in a neutral or "sniffing" position. The neutral position is desirable when administering anesthetics or such as when the patient is undergoing treatment in an intensive care unit.

The resistance to bending or flexing or other generally lateral movement of the neck is provided in part by the conforming cross-sectional shape of the neck depression and also by the convoluted character of the surface. The neck of the user sinks down into the convoluted surface farther than if the surface was flat and is thus partially laterally surrounded by the convoluted surface protrusions (or convolutions). The effectively softer surface allows the head and neck to sink farther and thus spreads out the weight distribution to lessen the pressure and make the person more comfortable. The convolutions also permit greater air circulation for increased patient comfort. Rolling of the head is also resisted by the convoluted surface. Since the head sinks down into the surface, the adjacent convolutions press against the side of the person's head to restrict the rolling movement.

The medical pillow also helps prevent hyperextension of the neck. Hyperextension is inhibited because the head depression is lower than neck depression thus inhibiting its movement parallel to the axis of the cervical spine.

Twisting and bending of the neck are also guarded against by the dual enveloping aspect of the comforming shape of the neck depression and the convoluted surface character of the top. The proper vertical support of both the head and neck further inhibits bending and flexing of the neck.

The medical pillow is particularly suited for supporting the person's head and neck while being administered an anesthetic. It also can be used for therapeutic reasons, such as while sleeping either at home, or at a hospital, and finds particular utility when used by persons undergoing intensive care.

Accident victims are especially suitable candidates for using the pillow. The pillow provides comfortable yet secure vertical positioning of the head and neck while insuring against rolling of the head or neck, as well as preventing hyperextension, hyperflexion, bending or twisting of the neck. Therefore, injury, or aggravation of an injury, during transport to a medical facility will be prevented.

The disclosed embodiment provides two neck depressions situated on opposite sides of the head depression. The bottom of the neck depressions are at different levels above the bottom of the pillow; this allows the pillow to be used for people of different sizes as well as when different amounts of flexure of the cervical spine is desired.

The disclosed construction of the preferred embodiment provides a pillow which is easily manufactured from a block of polyurethane foam and a piece of convoluted sheet foam. The head depression can be formed by cutting a trough between opposite sides of the block. The two neck depressions are then formed in the block at their respective heights. The normally shallow convoluted foam sheet is then bonded to the preferably smoothly curved cut surface of the block to form the top surface of the pillow. Thus, standard foam stock can be used in the manufacture of the pillow to reduce production costs.

Additional features and advantages of the invention will appear from the following description in which the preferred embodiment have been set forth in detail in conjunction with the accompanying drawings.

DETAILED DESCRIPTION OF THE PREFERRED EMBODIMENTS

Figure 1:
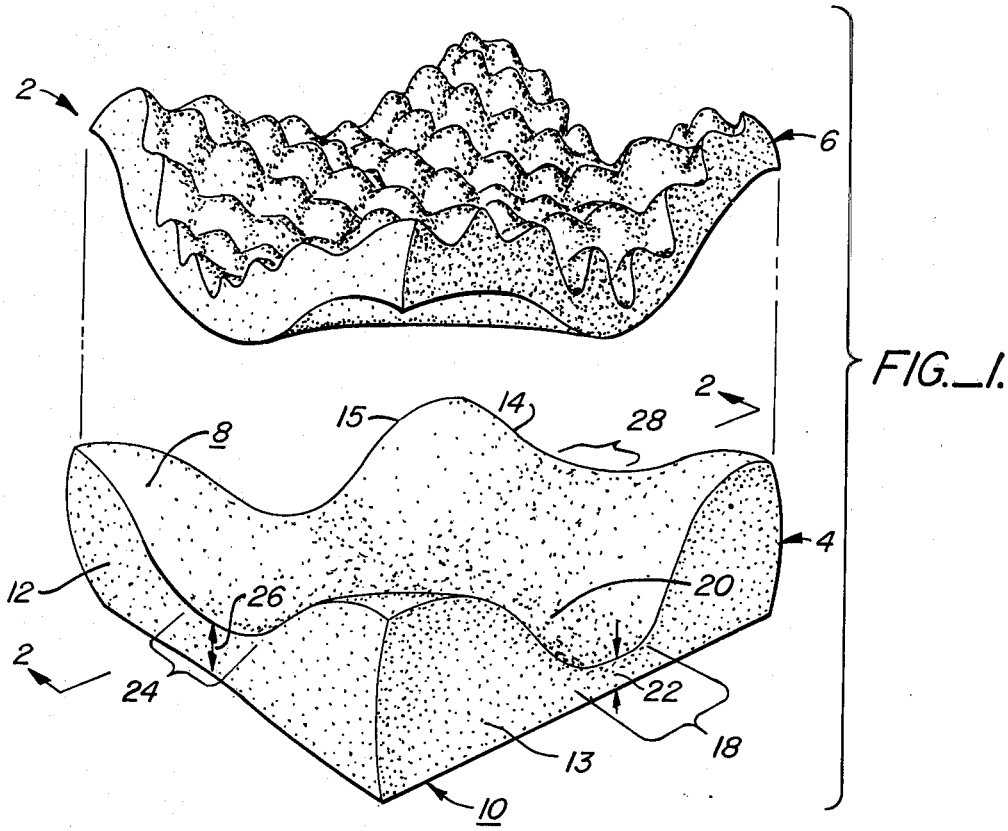
FIG. 1 is an exploded perspective view of the pillow of the present invention.

As shown in the figures, the medical pillow of the present invention includes a resilient foam base 4 and a convoluted resilient foam layer 6 bonded to the smoothly curving contoured upper surface 8 of the base.

The base has a generally rectangular bottom surface 10 and four upwardly extending, slightly convex side walls 12, 13, 14 and 15. Convoluted layer 6 and base 4 are preferably made from polyurethane foam. Layer 6 has a convoluted upper surface. This convoluted foam padding is commercially available in flat sheets, such as that sold under the "Eggcrate" trademark by Bio Clinic Company of Burbank, California and Media, Pennsylvania.

The contoured upper surface of the base includes a concave first (head) trough 18 extending between sides 13 and 15 of the base. The bottom 20 of trough 18 is at a first height 22 above bottom surface 10. A concave second (neck) trough 24 is formed in the upper surface of the base and extends between side wall 12 and first trough 18. The bottom of second trough 24 is at a second height 26 above the bottom surface of the base. Second height 26 is greater than first height 22, such heights being chosen so that the patient's neck is vertically and laterally supported by the convoluted layer overlying second trough 24 and the patient's head is vertically supported by the convoluted layer overlying first trough 18.

It should be noted that the convolutions overlying second trough 24 are generally inwardly directed. This inward direction of the convolutions helps keep the neck firmly yet comfortably in place and keeps the neck from bending or twisting. The use of the convoluted layer as the support surface for the head and neck enlarges the area over which the weight of the neck and head is distributed and allows the patient's head and neck to be somewhat enclosed or surrounded by the convoluted layer thus stabilizing the patient's head and neck. Because first height 22 is lower than second height 26, the head is cradled axially within the first trough much as the neck is cradled laterally within the second trough.

A third (neck) trough 28 is formed within the upper surface and extends between side 14 and first trough 18. The bottom of the third trough is at a third height 30 above bottom surface 10. Height 30 is above first height 22 and is different from second height 26 to allow the same pillow to be used for different size patients. In this embodiment, the third height is shown greater than the second height.

It will be noticed that contoured upper surface 8 has a smoothly continuous surface shape. This allows convoluted layer 6 to be more easily and effectively bonded to upper surface 8.

Figure 2:
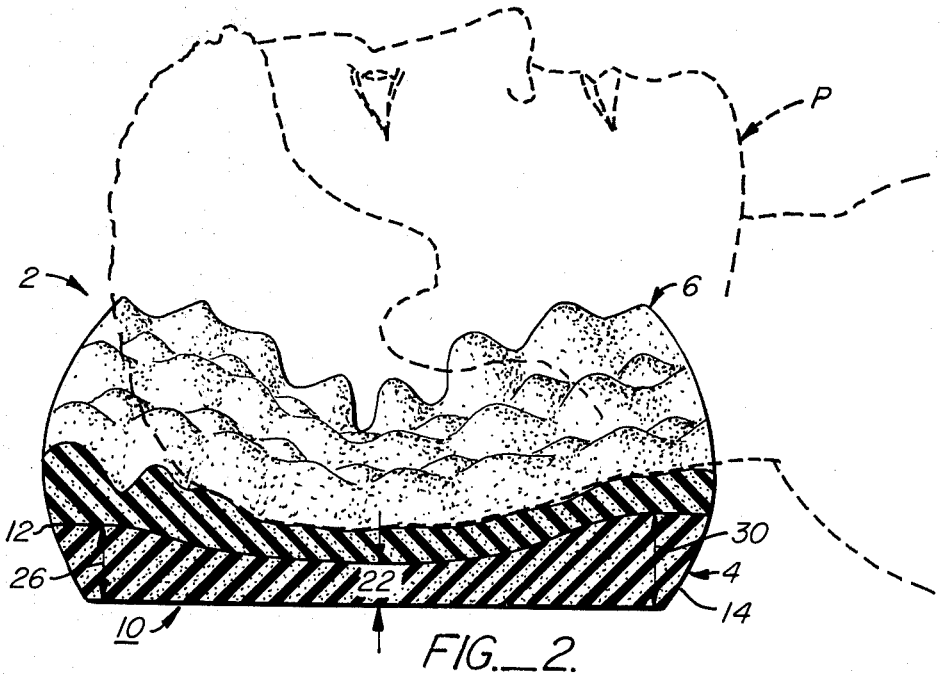
FIG. 2 is a cross-sectional view of the invention while in use showing the bottom coutour of the front and rear neck depressions and the head depression and showing a person's head in phantom.

The medical pillow is used generally as follows. As shown in FIG. 2, the head and neck of patient P are placed on the convoluted layer to be supported within first trough 18 and third trough 28 respectively. If the patient is exceptionally small, or for other specific reasons, the pillow can be rotated to have the neck of the patient placed on the convoluted layer to be supported within second trough 24. The patient's head and neck are effectively nestled within the convolutions of the convoluted layer. The enveloping action of the convolutions and the generally conforming cross-sectional shape of the neck troughs 24, 28 and of the head trough 18 combine to inhibit movement of the patient's head and neck. Having the bottom of the neck troughs elevated with respect to the bottom of the head trough insures adequate vertical support for the head and the neck while positioning the patient's head in a proper attitude, such as for the administration of an anesthetic.

In this application the medical pillow has usually been described in terms of its utility for administering anesthetics. However, it should be understood that the pillow of the present invention is also very useful for other purposes such as during transport of injured persons to or between hospitals and to encourage a normal curvature of the cervical spine while sleeping.

If desired, the pillow could be made from a single, unitary piece. However, it is expected that bonding the convoluted layer, as a stock item, to a formed base will be less expensive than forming the entire pillow froma single block of material. Further, by having the convoluted layer and base bonded from two separate elements, the firmness of the base and convoluted layer could be varied as desired. Also, the convolutions on the sides of the troughs naturally point inwardly when bonded to the contoured top to add to the lateral support of the neck. It is, however, to be understood that the medical pillow of the present invention can be produced from a single piece of material if desired.

If desired the first trough need not extend completely from one side to the other. However, forming the first trough and bonding the convoluted layer to the upper surface of the base may prove more difficult. The pillow need not be rectangular, but may be round or such other shape as desired. Other modifications and variations may be made to the preferred embodiment described herein without departing from the subject of the invention as defined by the following claims.

I claim:

1. A medical pillow for supporting the head and neck of a person while in a generally horizontal position comprising:

a resilient base having a contoured top, a bottom, and a circumferential side joining said top and bottom;

said contoured top having a first, head supporting depression area at a first level and located generally centrally of said top, and having a second, neck supporting depression area at a second level and extending between said circumferential side and said first depression area, said second level being higher than said first level to provide vertical support to the head and neck; and said contoured top having a plurality of upwardly extending convolutions substantially covering said first and second depression areas, said convolutions being relatively soft to at least partially laterally surround the head and neck to resist movement of the head and neck.

2. The medical pillow of claim 1 wherein said resilient base comprises a lower base element bonded to a juxtaposed upper base element.

3. The medical pillow of claim 1 wherein said convolutions are disposed in directions generally normal to said contoured top.

4. The medical pillow of claim 1 wherein said circumferential side is generally rectangular and includes a front, back, and first and second sides.

5. The medical pillow of claim 4 wherein said second, neck supporting depression area extends between said front side and said first, head supporting depression area.

6. The medical pillow of claim 5 wherein said first, head supporting depression area extends between said first and second sides.

7. The medical pillow of claim 5 further comprising a third, neck supporting depression area at a third level and extending between said back and said first, head supporting depression area, said third level being different from said second level and higher than said first level.

8. The medical pillow of claim 1 wherein said contoured top includes a third, neck supporting depression area at a third level and extending between said circumferential side and said first, head supporting depression, said third level being at a level different from said second level and higher than said first level.

9. The medical pillow of claim 8 wherein said third depression area is opposite said second depression area.

10. A resilient foam medical pillow for supporting the head and neck of a person of the type including a top, bottom and a circumferential side connecting the top and bottom, the top having a central head supporting depression area at a first level, wherein the improvement comprises:

a neck supporting depression area along said side of said pillow at a second level, said second level being spaced above said first level to provide vertical support for the head and neck of a person; and a plurality of upwardly extending convolutions substantially covering said head and neck supporting depression areas, said convolutions being relatively soft and having smoothly curving surfaces said convolutions at least partially surrounding the head and neck, whereby movement of the head and neck of the person is constrained to provide protection.

11. A medical pillow for the stabilized placement of the head and neck of a person when in a horizontal position, comprising:

a generally rectangular resilient foam body, said body having a generally flat bottom, a contoured top and at least one side connecting said bottom and said top;

said top having a generally centrally located first depression area having a generally arcuate contour for receipt of the person's head, said first area being at a first level above said bottom;

said top having a second depression area having a generally arcuate contour for receipt of said neck and extending between said first area and a first side, said second area being at a second level above said bottom, said second level being above said first level to provide vertical support to said neck and said head; and said first and second areas having a relatively soft convoluted surface to at least partially laterally surround the head and neck to restrict movement of said supported neck and head.

12. The medical pillow of claim 11 further comprising a third depression area in said top extending between a second side and said first area, said third area being at a third level above said bottom, said third level being different from said second level and above said first level.

13. The medical pillow of claim 12 wherein all of said top has said convoluted surface texture.

14. A medical pillow for supporting the head and neck of a person while in a generally horizontal position comprising:

a resilient base having a contoured top, a bottom, and a circumferential side joining said top and bottom;

said contoured top having a first, head supporting depression area at a first level and located generally centrally of said top, and having a second, neck supporting depression area at a second level and extending between said circumferential side and said first depression area, said second level being higher than said first level to provide vertical support to the head and neck, and having a third, neck supporting depression area at a third level and extending between said circumferential side and said first, head supporting depression, said third level being at a level different from said second level and higher than said first level; and said contoured top having a plurality of upwardly extending convolutions within said first and second depression areas.

15. The medical pillow of claim 14 wherein said third depression area is opposite said second depression area.

16. The medical pillow of claim 14 wherein said convolutions are relatively soft and have smoothly curving surfaces to at least partially laterally surround the head and neck to resist bending of the neck and rolling of the head.

17. A medical pillow for the stabilized placement of the head and neck of a person when in a horizontal position, comprising:

a generally rectangular resilient foam body, said body having a generally flat bottom, a contoured top and at least one side connecting said bottom and said top;

said top having a generally centrally located first depression area having a generally arcuate contour for receipt of the person's head, said first area being at a first level above said bottom;

said top having a second depression area having a generally arcuate contour for receipt of said neck and extending between said first area and a first side, said second area being at a second level above said bottom, said second level being above said first level to provide vertical support to said neck and said head;

said top having a third depression area in said top extending between a second side and said first area, said third area being at a third level above said bottom, said third level being different from said second level and above said first level; and said first, second and third areas having a convoluted surface texture to restrict movement of said supported neck and head.

18. The medical pillow of claim 17 wherein all of said top has said convoluted surface texture.

19. The medical pillow of claim 18 wherein said convoluted surface texture is a smoothly curving surface texture.

* * * * *